US011084689B2

(12) United States Patent
Steinhauer et al.

(10) Patent No.: US 11,084,689 B2
(45) Date of Patent: Aug. 10, 2021

(54) BRAKING DEVICE FOR A CAR OF A LIFT SYSTEM

(71) Applicant: TK Elevator Innovation and Operations GmbH, Duesseldorf (DE)

(72) Inventors: Eduard Steinhauer, Nürtingen (DE); Thomas Kuczera, Leinfelden-Echterdingen (DE); Marius Matz, Filderstadt (DE)

(73) Assignee: TK Elevator Innovation and Operations GmbH, Duesseldorf (DE)

( * ) Notice: Subject to any disclaimer, the term of this patent is extended or adjusted under 35 U.S.C. 154(b) by 290 days.

(21) Appl. No.: 16/071,534

(22) PCT Filed: Jan. 11, 2017

(86) PCT No.: PCT/EP2017/050480
§ 371 (c)(1),
(2) Date: Jul. 20, 2018

(87) PCT Pub. No.: WO2017/125293
PCT Pub. Date: Jul. 27, 2017

(65) Prior Publication Data

US 2019/0144240 A1 May 16, 2019

(30) Foreign Application Priority Data

Jan. 19, 2016 (DE) ..... 10 2016 200 593.6

(51) Int. Cl.
*B66B 5/22* (2006.01)
*B66B 1/06* (2006.01)

(52) U.S. Cl.
CPC . *B66B 5/22* (2013.01); *B66B 1/06* (2013.01)

(58) Field of Classification Search
CPC ..... B66B 5/22; B66B 1/06
See application file for complete search history.

(56) References Cited

U.S. PATENT DOCUMENTS 5,244,060 A * 9/1993 Tanaka ..... B66B 1/32 187/261
6,719,101 B2 * 4/2004 Hugel ..... B66B 5/22 187/372

(Continued)

FOREIGN PATENT DOCUMENTS

CN 105722781 A 6/2016
DE 10 2014 004 356 A 10/2015

(Continued)

OTHER PUBLICATIONS

English Translation of International Search Report issued in PCT/EP2017/050480, dated May 2, 2017 (mailed May 10, 2017).

(Continued)

*Primary Examiner* — Michael A Riegelman
(74) *Attorney, Agent, or Firm* — William J. Cassin

(57) ABSTRACT

A braking device may include first and second brake pads disposed opposite one another about a guide rail, for developing braking forces when the brake pads engage the guide rail. The first brake pad has a wedge shape and may taper in a wedge direction. A front side of the first brake pad facing the guide rail is aligned parallel to the guide rail, and a rear side of the first brake pad is angled corresponding to the wedge shape. The rear side of the first brake pad lies in a sliding manner against a contact surface of a first brake pad seat disposed at an angle corresponding to the first brake pad. In a first setting a locking device unblocks a sliding movement of the first brake pad, and in a second setting the locking device blocks the sliding movement of the first brake pad.

8 Claims, 4 Drawing Sheets

(56) References Cited

U.S. PATENT DOCUMENTS

| | | | | |
|---|---|---|---|---|
| 7,575,099 | B2 * | 8/2009 | Oh | B66B 5/06 187/247 |
| 9,120,643 | B2 * | 9/2015 | Meierhans | B66B 5/20 |
| 2011/1100761 | | 5/2011 | Dudde | |
| 2012/0175194 | A1 * | 7/2012 | Nikawa | B66B 5/22 187/376 |
| 2013/0081908 | A1 * | 4/2013 | Meierhans | B66B 5/18 187/359 |
| 2014/0008157 | A1 * | 1/2014 | Terry | B66B 5/22 187/359 |
| 2015/0353321 | A1 * | 12/2015 | Fargo | B66B 5/02 187/276 |
| 2016/0289045 | A1 * | 10/2016 | Osmanbasic | F16D 63/008 |
| 2017/0107080 | A1 * | 4/2017 | Steinhauer | B66B 1/36 |
| 2017/0291794 | A1 * | 10/2017 | Bitzi | B66B 1/32 |
| 2017/0320706 | A1 * | 11/2017 | Steinhauer | B66B 5/18 |
| 2019/0144240 | A1 * | 5/2019 | Steinhauer | B66B 5/22 187/376 |
| 2020/0062548 | A1 * | 2/2020 | Gainche | B66B 9/003 |

FOREIGN PATENT DOCUMENTS

| | | | |
|---|---|---|---|
| DE | 10 2014 104 458 | A | 10/2015 |
| EP | 1 930 282 | A | 6/2008 |
| FR | 775107 | A | 12/1934 |
| JP | H06-48672 | A | 2/1994 |
| WO | 2005/044709 | A1 | 5/2005 |
| WO | 2014086669 | A | 6/2014 |
| WO | 2015071188 | A | 5/2015 |
| WO | 2015144686 | A | 10/2015 |
| WO | 2015144781 | A | 10/2015 |

OTHER PUBLICATIONS

Office Action, dated Mar. 25, 2021, in European counterpart application No. EP 17701060.0.

* cited by examiner

BRAKING DEVICE FOR A CAR OF A LIFT SYSTEM

CROSS REFERENCE TO RELATED APPLICATIONS

This application is a U.S. National Stage Entry of International Patent Application Serial Number PCT/EP2017/050480, filed Jan. 11, 2017, which claims priority to German Patent Application No. DE 10 2016 200 593.6, filed Jan. 19, 2016, the entire contents of both of which are incorporated herein by reference.

FIELD

The present disclosure generally relates to lift systems such as elevators, including braking devices for cars of lift systems that are movable upward and downward in vertical shafts.

BACKGROUND

One known braking device is disclosed in WO 2015/144686A1. The braking device is designed for use in movements along a vertical lift shaft. So that such a braking device ensures the highest possible degree of safety, the control of the lift system is, as a rule, designed such that braking is triggered in any risk situation in order to bring the car to a standstill as quickly as possible. This is also to occur, in particular, should there be total failure of the lift system power supply, which is why the braking device is designed in a favorable manner such that it is held actively in an open state during operation and if the power supply is lost, at least one brake pad is automatically moved into engagement with the guide rail (in particular as a result of the compressive force of a prestressed spring).

Whereas such emergency braking when the car is moving downward is essential to prevent a possible crash, this does not apply when the car is moving upward. In this case, the car already comes to a standstill on account of the drive being switched off so that active braking of the upward movement is not only unnecessary but has even to be avoided under safety aspects as if the upward movement were abruptly obstructed, the passengers would hit their heads on the ceiling of the car with the risk of injuries.

In the case of more innovative lift systems, the car, however, is not only moved upward and downward but also between multiple vertically extending lift shafts. Such a lift system is disclosed, for example, in JP H06-48672.

Thus a need exists for a braking device that is able to be used for the braking of sideways travel, in particular of horizontal travel.

DETAILED DESCRIPTION

Figure 1:
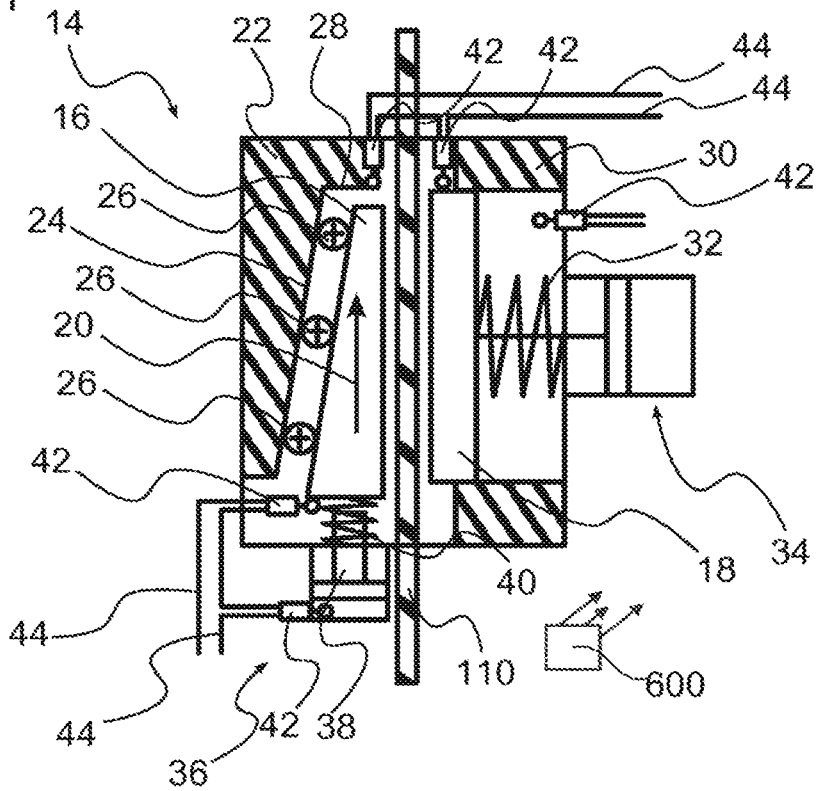
FIG. 1 is a schematic view of an example locking device in a first setting.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to braking devices for cars of lift systems that are movable upward and downward in a vertical shaft, where the car moves along one or multiple guide vertical rails. The braking device may include two oppositely situated brake pads that receive the guide rails between them and develop a braking effect as a result of frictional locking when they engage the guide rails.

In some examples, a braking device for a car of a lift system may include a first brake pad and a second brake pad, which are located opposite one another and receive a guide rail between them and develop a braking effect as a result of frictional locking when they engage the guide rail. In this connection, the first brake pad is realized in a wedge-shaped manner and tapers in the direction of a wedge direction. In this case, the front side of the first brake pad facing the guide rail is aligned parallel to the guide rail and the oppositely situated rear side is angled corresponding to the wedge shape. The braking device additionally includes a brake pad seat which comprises a contact surface at an angle which corresponds to the wedge-shaped brake pad, against which the rear side of the wedge-shaped brake pad lies in a sliding manner. The braking device additionally comprises a locking device with a first setting and a second setting, wherein the locking device is set up to unblock a sliding movement of the wedge-shaped first brake pad in opposition to the wedge direction in the first setting and to block the sliding movement of the wedge-shaped first brake pad in opposition to the wedge direction in the second setting.

The advantage of said design is that the braking device has two settings. In the case of the first adjustment of the braking device, the locking device assumes the first setting. In said configuration, the braking effect is dependent on the direction of travel. When traveling in opposition to the wedge direction (typically moving downward), there is active braking when the braking device is triggered. When traveling in the direction of the wedge direction (typically moving upward), in contrast there is reduced braking power up until there is no braking effect at all. In the case of the second adjustment of the braking device, in contrast, the locking device assumes the second setting. In said configuration the braking effect is independent of the direction of travel. Said adjustment is able to be used, in particular, for braking the movement between multiple vertically extending lift shafts (sideways movement).

In the first adjustment, the described effect is achieved as a result of one of the brake pads being realized in a wedge-shaped manner, tapering in the direction of a wedge direction and unblocking a sliding movement of the wedge-shaped brake pad in opposition to the wedge direction. When traveling in the direction of the wedge direction (typically moving upward), there is no or at any rate a small braking action on account of the following effect: when braking is triggered, i.e. transferring the oppositely situated brake pad into a closed state and engaging the guide rail, the wedge-shaped first brake pad is pulled in opposition to the wedge direction out of its first operating position as a result of frictional locking and slides away from the guide rails along the angled contact surface of the brake pad seat so that the frictional locking is eliminated again. When traveling in opposition to the wedge direction (typically moving downward), in contrast the following effect occurs: when braking is triggered, the wedge-shaped first brake pad is pulled in the wedge direction out of its first operating position as a result of frictional locking. If a sliding movement of the wedge-shaped brake pad is possible in said direction, it slides along the angled contact surface of the brake pad seat toward the guide rail so that the braking action is built up and strengthened gradually. The full braking effect does not occur until the wedge-shaped brake pad is no longer able to continue to move in the wedge direction. The full braking effect is therefore retarded. If the sliding movement of the wedge-shaped first brake pad is blocked in said direction, the wedge-shaped brake pad immediately acts as a usual brake pad. There is therefore neither retarded nor normal braking effect, not even reduced braking effect as in the case of traveling in the direction of the wedge direction.

The additional advantage of the wedge shape of the first brake pad is that the braking device is able to be ventilated in a simple manner in the first setting following the end of the braking operation by the car, for example with the aid of the drive, being moved in the wedge direction. Said movement of the car in the wedge direction automatically leads to the wedge-shaped first brake pad, which is still in contact with the rail once the braking operation has been completed, being moved in opposition to the wedge direction and consequently automatically sliding away from the guide rail. The braking device is consequently ventilated and the car unblocked.

In the second setting, in contrast, the wedge-shaped first brake pad is blocked from sliding in opposition to the wedge direction so that the above-described reducing effect of the frictional locking being eliminated again on account of a movement of the wedge-shaped brake pad, cannot occur. The wedge-shaped brake pad accordingly acts as a usual brake pad when travel is in the direction of the wedge direction when the braking device assumes the second setting.

In order to achieve the described effects, it is, in principle, sufficient when one of the two brake pads is realized in a wedge-shaped manner and is combined with a corresponding brake pad seat. The oppositely situated second brake pad is realized then, for example, in a cuboid manner with front and rear sides which are parallel to one another. In addition, the second brake pad does not forcibly have to be provided with a friction surface in order to form frictional locking with the guide rail. A counter force, which counters the pressing force of the first brake pad, has simply to be transmitted to the guide rail by the second brake pad. As a result, the second brake pad can also be realized, for example, as a roller arrangement which rolls off the guide rail during the braking operation.

The rear side of the wedge-shaped brake pad can lie directly slidingly on the contact surface or can lie slidingly on the contact surface indirectly by means of a roller bearing. As a result of a roller bearing, friction in said region is further reduced and the effect according to the invention improved even more.

The two brake pads, with the braking device in the closed position, engage the guide rails, preferably by one or both brake pads being pressed against the guide rails, each by means of one spring. This corresponds to the usual method of operation of the type of braking devices named in the introduction. With the present invention, in this case, it is possible to have only one cuboid-shaped brake pad being pressed, only one wedge-shaped brake pad including the brake pad seat, or two wedge-shaped brake pads including the brake pad seats. A wedge-shaped brake pad is pressed consequently always indirectly by means of the corresponding brake pad seat. The wedge-shaped brake pad and the seat consequently form a unit which replaces a conventional brake pad.

In the case of a preferred realization of the invention, at least one spring is prestressed for adapting the brake pad by an active mechanism with the braking device in the open state such that if the power supply to the braking device is interrupted, the at least one spring is released and the brake pads engage the guide rails. This type of triggering can ensure in the best way that in the case of any type of operational malfunction, including loss of power, the car is immediately braked when traveling downward.

As an alternative to this, according to a further embodiment of the invention, it can be provided that the two brake pads engage the guide rail with the braking device in the closed state by one or both brake pads being pressed against the guide rails, each by means of an actuator. Said pressing by means of the actuator can be effected in opposition to the resetting force of a spring which holds the relevant brake pad, with the braking device in the open state, at a spacing from the guide rail. The actuator can be, for example, a hydraulic device. In the case of said design, however, it is not possible to trigger the brake if there is an interruption in the power supply.

The brake pads used within the framework of the invention, i.e. both the at least one wedge-shaped brake pad and the cuboid-shaped brake pad, which is present where applicable, can be realized either in one piece or can in each case include a carrier and a brake lining. Materials disclosed in the prior art can be used for the one-piece brake pads or the brake linings, in particular, the brake pads or brake linings can be formed entirely or in part from a metallic material, a polymer material or a ceramic material. In a preferred manner, said materials include fillers to increase the friction and/or wear resistance.

According to a further realization of the invention, the first brake pad and the second brake pad are realized in a wedge-shaped manner in the above-described way and are combined with a corresponding brake pad seat. This means that both brake pads are realized in a wedge-shaped manner and taper in the direction of a (common) wedge direction, wherein the front sides of the brake pads facing the guide rail are aligned parallel to the guide rail and the oppositely situated rear sides are angled corresponding to the wedge shape. The braking device additionally includes two brake pad seats which comprise a contact surface at an angle which corresponds to the respective wedge-shaped brake pad, against which the rear side of the respective wedge-shaped first brake pad lies in a sliding manner. The locking device, in this case, is set up to unblock a sliding movement of the wedge-shaped brake pad in opposition to the wedge direction in the first setting and to block the sliding movement of the two wedge-shaped brake pads in opposition to the wedge direction in the second setting. In the case of said embodiment, the brake retardation can be strengthened even further when traveling in the wedge direction as the friction locking is retarded even further as a result of the sliding movement of both wedges. When, in the following description, the wedge-shaped brake pad and the brake pad seat are always only referred to in the singular for reasons of simplicity, the corresponding details also always apply to the case where both brake pads are realized correspondingly in a wedge-shaped manner.

In the case of a preferred embodiment, the brake pad seat comprises a stop surface for the first brake pad on its end lying in the wedge direction such that a sliding movement of the first brake pad along the contact surface of the brake pad seat in the wedge direction is limited by the stop surface and wherein the first brake pad is at a distance from the stop surface in a first operating position in which the locking device assumes the first setting. The advantage of this is that in the case of braking, when traveling in opposition to the wedge direction, a retarding effect occurs as, when frictional locking is present, the wedge-shaped first brake pad is pulled out of its first operating position in the wedge direction. The wedge-shaped first brake pad then slides along the angled contact surface of the brake pad seat toward the guide rails until the first brake pad reaches the stop surface and the braking action has risen to its full strength. At the same time, the advantage of the stop surface is that the wedge-shaped first brake pad cannot be drawn-in arbitrarily such that the braking device is prevented from jamming.

In the case of a preferred further development, in the second setting the locking device is set up in order to lock the wedge-shaped first brake pad in a second operating position in which the wedge-shaped first brake pad lies against the stop surface. In this way, a movement of the wedge-shaped first brake pad is prevented both in the wedge direction and in opposition to the wedge direction. The wedge-shaped brake pad acts as a usual brake pad without any retarding effect. In particular, the braking effect of the brake pad locked in this way is independent of the direction of travel.

In the case of a realization variant of the braking device according to the invention, the locking device includes a locking bolt which is movable between a first position in the first setting and a second position in the second setting. In this connection, the locking bolt is set up to block the sliding movement of the wedge-shaped first brake pad in opposition to the wedge direction in a positive locking manner in the second position. In the first position, in contrast, the locking bolt unblocks the sliding movement of the wedge-shaped first brake pad in opposition to the wedge direction. Consequently, the desired adjustability of the braking device can be achieved as a result of said simple mechanical measure. In this case, the mobility of the locking bolt can be realized electromechanically, electromagnetically, hydraulically or pneumatically.

According to a further development, the wedge-shaped first brake pad is connected to a resetting device, in particular to a spring in order to move the first brake pad out of the second operating position into the first operating position. The achievement here is that the first brake pad moves into the starting position again after the braking operation by means of spring force.

In the case of a preferred realization variant, the spring is realized as a helical spring which surrounds the locking bolt. As a result, a particularly space-saving design of the locking device is achieved.

In the case of an alternative embodiment of the braking device, the locking device includes a magnet which is set up such that the magnetic forces thereof act in such a manner on the wedge-shaped first brake pad in the second setting that the sliding movement of the wedge-shaped first brake pad in opposition to the wedge direction is blocked. Said embodiment can be further developed in such a manner that the magnetic forces of the magnet, which act on the wedge-shaped first brake pad, are reduced in the first setting such that the sliding movement of the wedge-shaped first brake pad in opposition to the wedge direction is unblocked. The advantage of said design of the locking device is that mechanical contact between the locking device and the wedge-shaped first brake pad is not necessary. As a result, wear on the locking device can be reduced.

In the case of a preferred further development, the magnet is an electromagnet which is de-energized in the first setting and is energized in the second setting. The advantage of this is that in the case of an emergency power failure, the first setting is automatically assumed such that in the case of a braking operation when traveling in opposition to the wedge direction (typically downward direction), the retarding effect of the wedge-shaped brake pad occurs.

The invention additionally relates to a car for a lift system with an afore-described braking device. The car, in this case, has the advantages which have been described above with reference to the braking device. In this case, the braking device is arranged typically in such a manner on the car that the wedge direction is directed vertically upward.

In addition, the invention relates to a lift system having at least two lift shafts and at least one car with a cabin and a guide device. In this connection, the cabin is mounted so as to be rotatable about a horizontal rotational axis relative to the guide device. A vertically extending guide rail, along which the car is movable, is provided in each lift shaft. In addition, each guide rail is realized with a rotatable segment, wherein the rotatable segments are alignable with respect to one another in such a manner that the car is movable along the segments between the lift shafts. In addition, an above-described braking device is arranged on the guide device such that the braking device is entrained when the guide device is rotated relative to the cabin.

The invention additionally relates to a method for operating an above-described lift system wherein the locking device is in the first setting during the movement of the car along the vertically extending guide rail and in the second setting during the movement between the lift shafts.

On account of the design according to the invention of the braking device, the advantage of the lift system and the method is that the same braking device can be used both for movements along the vertically extending lift shafts (whilst the locking device assumes the first setting) and for sideways directed movements between the lift shafts (whilst the locking device assumes the second setting). Dispensing with an additional braking device for sideways movements enables the car to be constructed in a particularly light manner and consequently the lift to be energy-saving.

FIG. 1 shows a schematic cross sectional representation of a first embodiment of a braking device 14 according to the invention for a car of a lift system. The braking device 14 includes a first brake pad 16 and a second brake pad 18 which are situated opposite one another and receive a guide rail 110 between them. With the braking device 14 in the open state, the brake pads 16 and 18 do not engage the guide rail 110 but move parallel to the guide rail 110 contactlessly when the car is traveling. The first brake pad 16 is realized in a wedge-shaped manner and tapers in a wedge direction 20. The wedge direction 20 is parallel to a main direction of extension of the guide rails 110. The first brake pad 16 is oriented in such a manner that the front side of the first brake pad 16 facing the guide rails 110 is aligned parallel to the guide rails 110 and the oppositely situated rear side is angled corresponding to the wedge shape. The braking device 14 additionally includes a brake pad seat 22 which comprises a contact surface 24 at an angle which corresponds to the wedge-shaped first brake pad 16. Said angled rear side of the wedge-shaped first brake pad 16 lies slidingly against the brake pad seat 22 by means of a roller bearing 26.

On its end lying in the wedge direction 20, the brake pad seat 22 comprises a stop surface 28 for the brake pad 16 such that a sliding movement of the first brake pad 16 in the wedge direction 20 along the contact surface 24 of the brake pad seat 22 is limited by the stop surface 28.

The second brake pad 18, which is situated opposite the wedge-shaped first brake pad 16, is realized in a cuboid-shaped manner. Said second brake pad 18 is movable toward the guide rail 110, whilst the brake pad seat 30 is stationary (with reference to the braking device 14). With the braking device 14 in the closed state, the cuboid-shaped second brake pad 18 can be pressed against the guide rails 110 by means of a spring 32, said spring 32 being prestressed by means of an active mechanism 34 when the braking device 14 is in the open state. When braking is triggered by a control signal, but also when the energy supply fails, the effect of the mechanism 34 is eliminated and the brake pads 16 and 18 engage the guide rails 110 as a result of the pressing force of the spring 32.

The braking device 14 additionally comprises a locking device 36 with a first setting and a second setting. The locking device 36, in the case of said embodiment, includes a locking bolt 38 which is movable between a first position in the first setting and a second position in the second setting. The movement of the locking bolt 38 can be realized, for example, electromagnetically, hydraulically, pneumatically or electromechanically. FIG. 1 shows the locking device 36 in the first setting. In said first setting, the locking device 36 unblocks a sliding movement of the wedge-shaped brake pad 16 in opposition to the wedge direction 20. The locking bolt 38 of the locking device 36 consequently does not block the sliding movement of the wedge-shaped brake pad 16 in opposition to the wedge direction 20 but unblocks it.

The brake pad 16 is situated, in the present case, in a first operating position in which it is at a spacing from the stop surface 28. As a result of said spacing, a defined sliding movement of the wedge-shaped first brake pad 16 in the wedge direction 20 is possible. The wedge-shaped first brake pad 16 is held in said first operating position by means of the spring 40. The spring 40 is realized as a helical spring which surrounds the locking bolt 38, which results in a particularly space-saving realization.

The shown first setting of the locking device 36 is set during movement of the car along a vertically extending guide rail 110. In said situation, braking can occur during a downward movement of the car or braking can occur during an upward movement of the car. If braking is triggered during a downward movement of the car, the wedge-shaped first brake pad 16, together with the brake pad seat 22, has a retarding effect. As a result of the friction that occurs, the wedge-shaped first brake pad 16 is drawn-in in the wedge direction and slides by means of the roller bearing 26 along the angled contact surface 24 of the brake pad seat 22 in the wedge direction 20 and toward the guide rails 110. The braking effect is retarded in this way. There is frictional locking between the brake pads 16 and 18 and the guide rail 110. The downward movement of the car is braked, which prevents the car crashing in the event of a malfunction.

When braking is triggered during an upward movement of the car, it is, in contrast, not such a strong braking effect as the wedge-shaped first brake pad 16 is pulled in opposition to the wedge direction as a result of the initially occurring friction. In this case, the spring 40 is compressed and the first brake pad 16 slides in opposition to the wedge direction 20 along the angled contact surface 24 of the brake pad seat 22 by means of the roller bearing 26 and away from the guide rails 110. The frictional locking is consequently immediately reduced, as a result of which the braking effect is clearly reduced. Sudden braking of the car when traveling upward, which can result in serious injuries to the passengers, is consequently limited in the case of the braking device 14 according to the invention.

In the case of an alternative embodiment, the first brake pad 16 lies against the stop surface 28 in the first operating position. Consequently, in the case of said variant, it is not possible for the wedge-shaped first brake pad 16 to slide in the wedge direction 20. This results in there not being any retarding effect when braking during a downward movement. Instead of which, the effect of the wedge-shaped first brake pad 16 is the same as a normal brake pad. When braking during an upward movement, in contrast, the same described effect occurs such that the first brake pad 16 slides in opposition to the wedge direction 20 and away from the guide rail 110 such that the braking effect is reduced.

Additionally shown in FIG. 1 are various sensors 42, which are connected to a control device 600 by means of control lines 44 and enable the correct positioning of the most important components to be monitored. As the braking device 14 is a safety-related component of the lift system, the operability of the braking device 14 must be ensured at all times.

Figure 2:
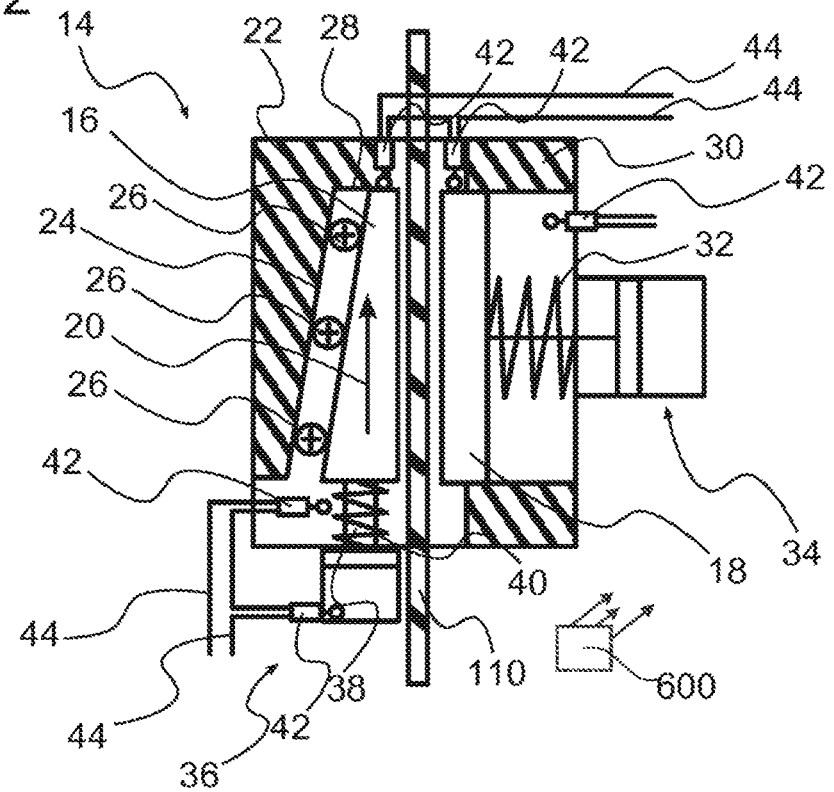
FIG. 2 is a schematic view of the example locking device of FIG. 1 in a second setting.

FIG. 2 shows the same embodiment of the braking device 14 according to the invention when the locking device 36 assumes the second setting. The wedge-shaped brake pad 16 is locked in a second operating position in which it lies against the stop surface 28. The locking bolt 38 is in the second setting in which it blocks the sliding movement of the wedge-shaped brake pad 16 in opposition to the wedge direction in a positive locking manner.

The shown second setting of the locking device 36 is set during movement of the car between the lift shafts, that is to say typically horizontally. In the case of said setting, the braking effect is independent of the direction of movement of the car. During movement between the lift shafts, the same braking device 14 can consequently be used as just another shoe brake. No retarding effect occurs as a result of the wedge shape of the wedge-shaped first brake pad 16. No additional braking device has to be provided for movement between the lift shafts.

Figure 3:
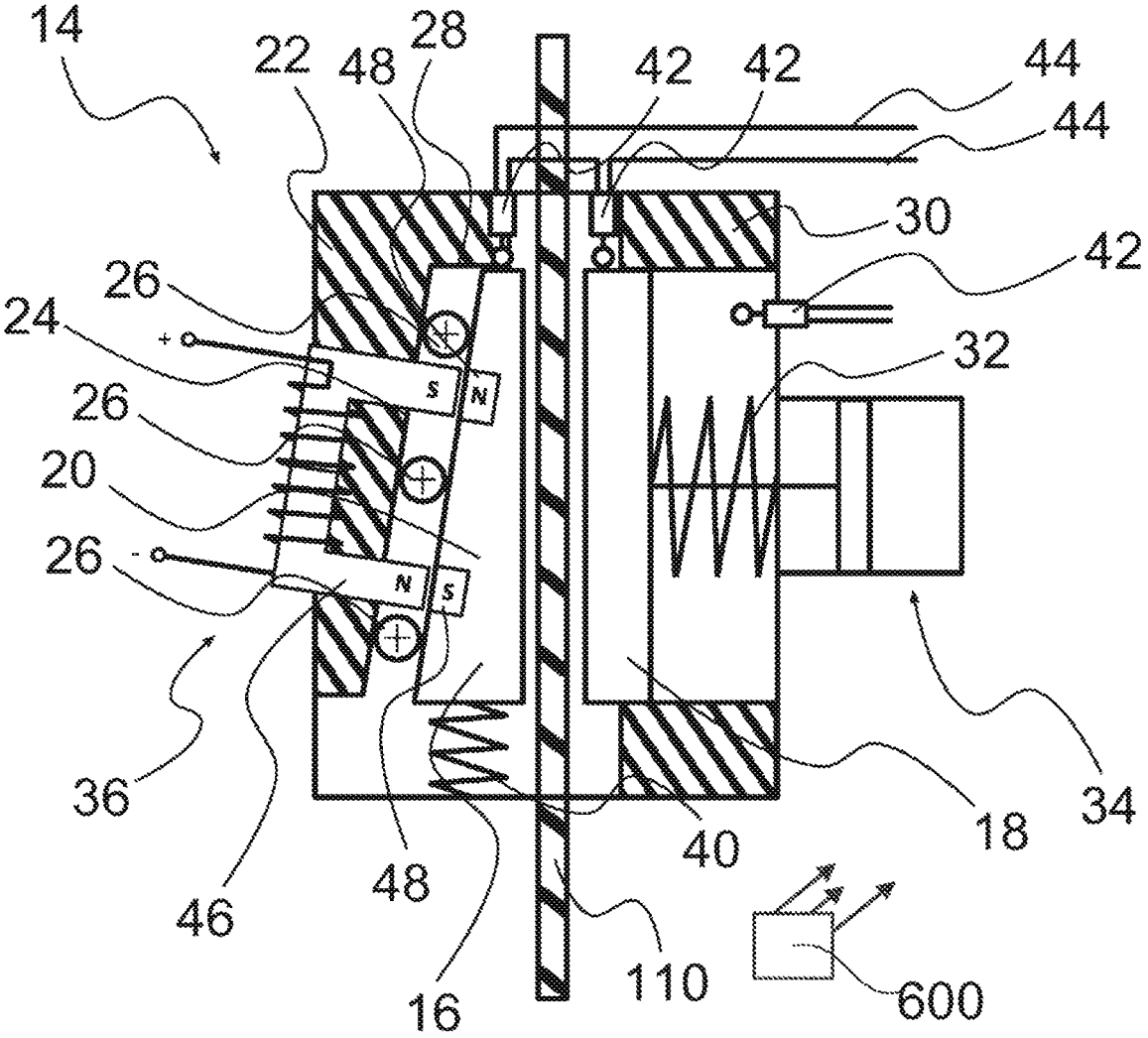
FIG. 3 is a schematic view of another example braking device.

FIG. 3 shows a schematic representation of a second embodiment of the braking device 14 according to the invention when the locking device 36 assumes the second setting. In the case of said variant, the locking device 36 includes a magnet 46 which is realized as an electromagnet. The two settings of the locking device 36 differ in this case by the energization of the electromagnet. In the shown second setting, the electromagnet 46 is energized, whereas in the first setting it is de-energized. In the second setting, the magnetic forces of the electromagnet 46 act in such a manner on the wedge-shaped brake pad 16 that the sliding movement of the wedge-shaped first brake pad 16 in opposition to the wedge direction 20 is blocked. Opposite the poles of the electromagnet 46, the wedge-shaped brake pad 16 comprises permanent magnets 48. As a result of the energization of the electromagnet 46, a magnetic field is formed at the poles of the electromagnet 46 which attracts the permanent magnets 48 and thus moves the wedge-shaped first brake pad 16 into the shown second operating position and locks it there. Movement of the wedge-shape first brake pad 16 in the wedge direction 20 is blocked by the stop surface 28 in the second operating position. The locking device 36, in contrast, blocks a sliding movement in opposition to the wedge direction 20 with the electromagnet 46 by means of magnetic force.

Instead of using permanent magnets 48, in the case of an alternative realization variant the rear side of the wedge-shaped first brake pad 16 comprises a ferromagnetic material. In this case too, the wedge-shaped first brake pad 16 is moved by the magnetic field of the electromagnet 46 into the second operating position and locked there. However, the advantage of using permanent magnets 48 is, accordingly, that it is possible to use a weaker electromagnet in order to realize a magnetic attraction of the same strength.

In the first setting of the locking device 36, the electromagnet 46 is de-energized. The magnetic forces of the electromagnet 46 are consequently reduced in the first setting and the sliding movement of the wedge-shaped brake pad 16 in opposition to the wedge direction 20 is unblocked. The wedge-shaped first brake pad 16 consequently assumes, on account of its weight, the first operating position which has already been shown and explained in FIG. 1. The wedge-shaped first brake pad 16 is mounted in said first operating position by means of the spring 40. The spring 40 is realized as a helical spring.

Instead of an electromagnet 46, which is de-energized in the first setting and is energized in the second setting, the same effect can also be achieved by the combination of a permanent magnet and an electromagnet. In said case, the two settings are precisely interchanged. In the second setting, the electromagnet is de-energized and only the magnetic forces of the permanent magnet act in such a manner on the wedge-shaped first brake pad 16 that the sliding movement of the wedge-shaped first brake pad 16 in opposition to the wedge direction 20 is blocked. When the electromagnet is energized (first setting), said electromagnet generates a field which eliminates the magnetic field of the permanent magnet at least in part such that the wedge-shaped brake pad is unblocked. In this case too, therefore, the overall magnetic forces are reduced in the first setting and the wedge-shaped first brake pad is unblocked.

Figure 4:
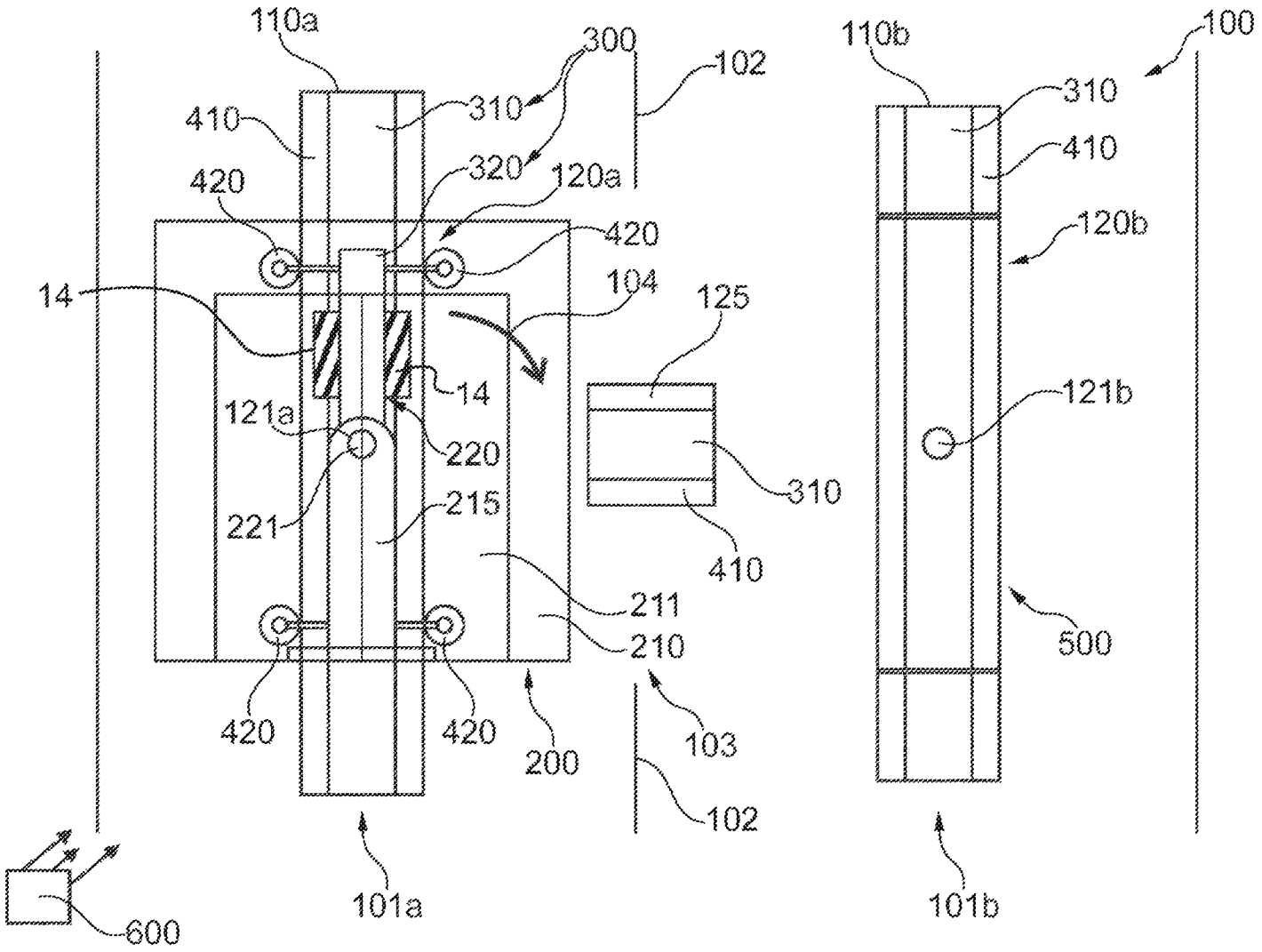
FIG. 4 is a schematic view of an example lift system when traveling vertically.
Figure 5:
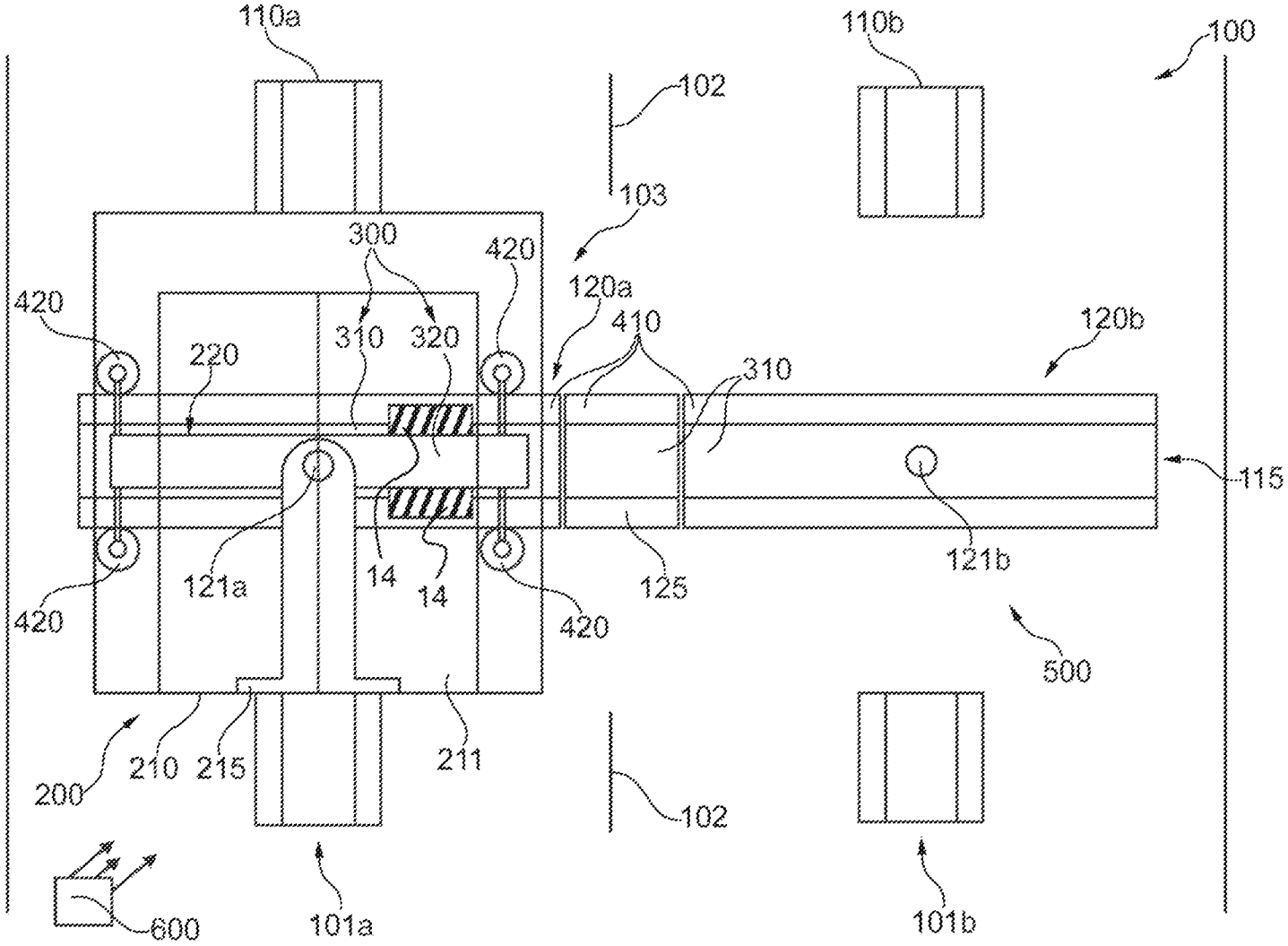
FIG. 5 is a schematic view of an example lift system configured to travel between lift shafts.

FIGS. 4 and 5 show a schematic representation of a preferred design of a lift system according to the invention which is designated by the reference 100. The lift system 100 includes two lift shafts 101*a* and 101*b*. A physical barrier 102, for example a partition or a wall, can be realized at least in part between the lift shafts 101*a* and 101*b*. However, it is also possible to dispense with a physical barrier 102 between the lift shafts 101*a* and 101*b*.

A first guide rail 110*a* is arranged in a first lift shaft 101*a* and a second guide rail 110*b* in a second lift shaft 101*b*. A car 200, which is situated in the lift shaft 101*a* or 101*b*, is movable along said guide rails 110*a* or 110*b*.

The car 200 includes a cabin 210 and a frame or guide device 220. The guide device 220 functions as suspension for the cabin 210. The cabin 210 is designed as a so-called rucksack suspension and comprises an L-shaped support structure 215. In this connection, the support structure 215 absorbs the weight of the cabin 210 through its short leg. The long leg of the L-shaped support structure 215, in contrast, is connected to the first guide rail 110*a* by means of the guide device 220. The advantage of said rucksack realization is that the guide rail is only necessary on one side of the cabin 210.

The guide device 220 is connected to the cabin 210 by means of a horizontal rotational axis 121*a*. The cabin 210, in this case, is mounted so as to be rotatable about the horizontal rotational axis 121*a* relative to the guide device 220.

The car 200 is movable along the guide rails 110*a* or 110*b* by means of a linear drive 300. The guide rails 110*a* or 110*b*, in this case, form a first element 310 of said linear drive 300. Said first element 310, in this case, is realized in particular as a primary part or as a stator 310 of said linear drive 300, further in particular as a long stator.

A second element 320 of the linear drive 300 is arranged on the guide device 220 of the car 200. Said second element 320 is realized, in particular, as a secondary part or reaction part of the linear drive 300. The second element 320 is realized, for example, as a permanent magnet.

The guide rails 110*a* and 110*b* are not only realized as a first element 310 of the linear drive 300, but at the same time also as guide rails for the car 200. The guide rails 110*a* or 110*b* comprise, in particular, a suitable guide element 410 for this purpose. Guide rollers 420, which are realized on the guide device 220 of the car 200, cooperate with said guide element 410.

The guide device 220 of the car 200 additionally comprises two braking devices 14 according to the invention, each with two oppositely situated brake pads which have been described with reference to FIGS. 1-3. In this case, both braking devices 14 are arranged in such a manner on the guide device 220 that, in each case, a portion of the first guide rail 110*a* comes to rest between the two oppositely situated brake pads of the two braking devices 14.

The car 200 comprises a rucksack suspension. The guide device 220 and guide rails 110*a* or 110*b* are arranged on one side, in particular on a rear side, of the car 200. Said rear side, in this case, lies opposite an entrance side of the car 200. The entrance side of the car 200 comprises a door 211. As the guide rails 110*a* or 110*b* function both as guide rails and as part of the linear drive 300, essentially no additional elements are required in the lift shafts 110*a* or 110*b* in order to move the car 200. According to the invention, the car 200 is not limited to be moved only within one of the lift shafts 110*a* or 110*b* but can be moved between the two lift shafts 110*a* and 110*b*.

A control device 600, which is shown in a purely schematic manner in the figures, is in particular set up programmatically for the purpose of carrying out a preferred embodiment of a method according to the invention for operating the lift system 100. The control device 600, in this case, actuates, in particular, the linear drive 300 and moves the car 200. In addition, the control device 600 controls the changing or moving of the car 200 between the lift shafts 110*a* and 110*b*. The control device 600, in this case, additionally controls the setting of the two braking devices 14. During movement of the car 200 along the vertically extending first guide rail 110*a*, the locking devices of the two braking devices 14 are actuated in such a manner that they are each in the first setting. During movement between lift shafts, the locking devices are actuated, in contrast, such that they are in the second setting.

Described below by way of FIGS. 4 and 5 as an example is that the car 200 is first of all moved in the lift shaft 101*a* and is then transferred from the first lift shaft 101*a* into the second lift shaft 101*b*. A change between the lift shafts 101*a* and 101*b* is effected, in this case, in particular, in the implementation plane 500. The barrier 102 comprises an opening 103 in the region of said implementation plane 500. The car 200 can be moved between the lift shafts 101*a* and 101*b* through said opening 103. The first guide rail 110*a* comprises a first rotatable segment 120*a* and the second guide rail 120*b* a second rotatable segment 120*b* in the region of said implementation plane 500. The first segment 120*a* or the second segment 120*b* is mounted so as to be rotatable about a first horizontal rotational axis 121*a* or around a second horizontal rotational axis 121*b*. The rotatable segments 120*a* or 120*b* are also actuated by the control device 600.

The rotatable segments 120*a* and 120*b* are shown having a rectangular form in a purely exemplary manner in the figures. The segments 120*a* and 120*b* can also be realized curved in an arcuate manner at their ends at which they adjoin the remaining parts of the guide rails 110*a* or 110*b*. Correspondingly, the guide rails 110*a* or 110*b* can also be curved in an arcuate manner in the opposite direction at the points at which they adjoin the segments 120*a* or 120*b*. It is consequently ensured that the segments 120*a* or 120*b* do not knock or become wedged on the remaining parts of the guide rails 110*a* or 110*b* in the course of the rotation.

To transfer the car 200 from the first lift shaft 101*a* into the second lift shaft 101*b*, the segments 120*a* and 120*b* are rotated from a vertical alignment, as is shown in FIG. 4, into a horizontal alignment, as is shown in FIG. 5 and explained in detail further below.

In addition, a balance rail element 125 is arranged in the region of the implementation plane 500 between the guide rails 110*a* and 110*b*. Said balance rail element 125 serves for bridging a space or gap between the segments 120*a* and 120*b* which are rotated in the horizontal alignment. The balance rail element 125 functions analogously to the guide rails 110*a* and 110*b* as a first element 310 of the linear drive 300 and comprises guide elements 410 in order to serve at the same time as a horizontal guide rail for the car 200.

Analogously to the guide rails 110*a* or 110*b*, the balance rail element 125 can be realized in a curved manner at its ends, in particular curved in the opposite direction to the corresponding ends of the segments 120*a* or 120*b*.

The car 200 is first of all moved along the first guide rail 110*a* into the implementation plane 500 and consequently to the rotatable segment 120*a*. FIG. 4 shows that the car 200 is already situated in said implementation plane 500. The first segment 120*a* of the first guide rail 110*a* is rotated by 90° about the first horizontal rotational axis 121*a*. This is indicated by the arrow 104. In addition, the second segment 120*b* of the second guide rail 110*b* is rotated by 90° about the second horizontal rotational axis 121*b*. When the first segment 120*a* is rotated, the guide device 220 of the car 200 is also rotated by 90°. Consequently, the two braking devices 14 are also rotated by 90°. The alignment of the cabin 210, in contrast, remains unchanged, which is realized by a rotation of the cabin 210 relative to the guide device 220 by −90°.

FIG. 5 shows a schematic representation of the lift system 100 analogously to FIG. 4, the first segment 120*a* and the second segment 120*b* each being rotated by 90° into the horizontal alignment. The cabin 210 is situated relative to the guide device 220 in the second setting.

As can be seen in FIG. 5, the first segment 120*a*—rotated into the horizontal alignment, the second segment 120*b*—rotated into the horizontal alignment and the balance rail element 125 form a horizontal guide rail 115. The horizontal guide rail 115 is a (substantially) closed guide rail and is realized (substantially) without any space. In order then to convert the two braking devices 14 to a horizontal movement of the car 200, the control device 600 actuates the two locking devices and moves them into the second setting in which a sliding movement of the wedge-shaped brake pads in opposition to the wedge direction is blocked. In the case of said setting, the braking effect is independent of the direction of travel of the car 200. A retarding braking effect occurs through the wedge shape of the wedge-shaped first brake pad 16. The braking device according to the invention can consequently be used as a usual shoe brake for traveling between the lift shafts. No additional braking devices have to be provided especially for traveling between the lift shafts.

The car 200 is then moved along the horizontal guide rail 115. The second element 320 of the linear drive 300 on the car 200 interacts, in this case, with the first element 310 of the linear drive, here therefore the horizontal guide rail 115. The car 200 can then be moved from the first lift shaft 101*a* into the second lift shaft 101*b* and consequently changes between the lift shafts 101*a* and 101*b*.

LIST OF REFERENCES

Braking device 14
First brake pad 16
Second brake pad 18
Wedge direction 20
Brake pad seat 22
Contact surface 24
Roller bearing 26
Stop surface 28
Brake pad seat 30
Spring 32
Mechanism 34
Locking device 36
Locking bolt 38
Spring 40
Sensors 42
Control lines
Magnet 46
Permanent magnet 48
Lift system 100
First lift shaft 101*a*
Second lift shaft 101*b*
Barrier 102
Opening 103
Arrow 104
Guide rail 110
First guide rail 110*a*
Second guide rail 110*b*
Horizontal guide rail 115
First rotatable segment 120*a*
Second rotatable segment 120*b*
First rotational axis 121*a*
Second rotational axis 121*b*
Balance rail element
Car 200
Cabin 210
Door 211
Support structure 215
Guide device 220
Linear drive 300
First element of the linear drive, primary part 310
Second element of the linear drive, secondary part 320
Guide element 410
Guide roller 420
Implementation plane 500
Control device 600

What is claimed is:

1. A braking device for a car of a lift system, the braking device comprising:

a guide rail;

a first brake pad and a second brake pad disposed opposite one another so as to receive the guide rail between the first and second brake pads, wherein the first and second brake pads are configured to develop a braking effect as a result of frictional locking when the first and second brake pads engage the guide rail, wherein the first brake pad has a wedge shape and tapers in a wedge direction, wherein a front side of the first brake pad facing the guide rail is aligned parallel to the guide rail, wherein a rear side of the first brake pad opposite the front side is angled corresponding to the wedge shape;

a first brake pad seat that comprises, an angled contact surface against which is disposed the rear side of the first brake pad to permit the first brake pad to be slidably movable on the first brake pad seat, and a stop surface configured to contact an end of the first brake pad to limit the sliding movement of the first brake pad along the contact surface of the first brake pad seat in the wedge direction; and a locking device having a locking bolt that is movable between a first position, in which the locking bolt is spaced apart from the first brake pad to permit sliding motion between the first brake pad and the first brake pad seat, and a second position, in which the locking bolt blocks the first brake pad in a positive locking manner to prevent sliding movement of the first brake pad in a direction opposite the wedge direction, the locking device being configured such that, in a first setting, the locking bolt is disposed in the first position, such that the end of the first brake pad is spaced apart from the stop surface of the first brake pad seat to permit the first brake pad to be slidably movable in either of the wedge direction, or a direction opposite the wedge direction, and in a second setting, the locking bolt is disposed in the second position and locks the first brake pad in a second operating position in which the first brake pad lies against the stop surface of the first brake pad seat.

2. The braking device of claim 1 wherein the second brake pad is cuboid shaped, wherein front and rear sides of the second brake pad are parallel to one another.

3. The braking device of claim 1, wherein the locking device assumes the first setting when the first brake pad is in a first operating position in which the first brake pad is spaced apart from the stop surface of the first brake pad seat.

4. The braking device of claim 3 wherein the first brake pad is connected to a resetting device to move the first brake pad from the second operating position into the first operating position.

5. The braking device of claim 3 wherein the first brake pad is connected to a spring that moves the first brake pad from the second operating position into the first operating position.

6. The braking device of claim 5 wherein the spring is a helical spring that surrounds a locking bolt of the locking device.

7. A lift system comprising:

two lift shafts;

a car with a cabin and a guide device, wherein the cabin is mounted relative to the guide device so as to be rotatable about a horizontal rotational axis;

a vertically extending guide rail disposed in each of the two lift shafts, wherein the car is movable along the vertically extending guide rails, wherein each of the vertically extending guide rails comprises a rotatable segment, wherein the rotatable segments are alignable with one another such that the car is movable along the rotatable segments between the two lift shafts; and a braking device disposed on the guide device of the car, wherein the braking device includes, a first brake pad and a second brake pad disposed opposite one another so as to receive a guide rail of the two lift shafts between the first and second brake pads, wherein the first and second brake pads are configured to develop a braking effect as a result of frictional locking when the first and second brake pads engage the guide rail, wherein the first brake pad has a wedge shape and tapers in a wedge direction, wherein a front side of the first brake pad facing the guide rail is aligned parallel to the guide rail, wherein a rear side of the first brake pad opposite the front side is angled corresponding to the wedge shape;

a first brake pad seat that comprises, an angled contact surface against which is disposed the rear side of the first brake pad to permit the first brake pad to be slidably movable on the first brake pad seat, and a stop surface configured to contact an end of the first brake pad to limit the sliding movement of the first brake pad along the contact surface of the first brake pad seat in the wedge direction; and a locking device having a locking bolt that is movable between a first position, in which the locking bolt is spaced apart from the first brake pad to permit sliding motion between the first brake pad and the first brake pad seat, and a second position, in which the locking bolt blocks the first brake pad in a positive locking manner to prevent sliding movement of the first brake pad in a direction opposite the wedge direction, the locking device being configured such that, in a first setting, the locking bolt is disposed in the first position, such that the end of the first brake pad is spaced apart from the stop surface of the first brake pad seat to permit the first brake pad to be slidably movable in either of the wedge direction, or a direction opposite the wedge direction, and in a second setting, the locking bolt is disposed in the second position and locks the first brake pad in a second operating position in which the first brake pad lies against the stop surface of the first brake pad seat.

8. A method for operating the lift system of claim 7, the method comprising:

positioning the locking device in the first setting during movement of the car along the vertically extending guide rail; and positioning the locking device in the second setting during movement of the car between the two lift shafts.

* * * * *